US007461471B2

(12) United States Patent
Kiniry et al.

(10) Patent No.: US 7,461,471 B2
(45) Date of Patent: Dec. 9, 2008

(54) SNOWSHOE BINDING

(75) Inventors: Daniel P. Kiniry, Barre Town, VT (US); Francis E. Mahoney, Barre Town, VT (US); Steven R. Burke, Huntington Beach, CA (US)

(73) Assignee: K2 Snowshoes, Inc., Carlsbad, CA (US)

( * ) Notice: Subject to any disclaimer, the term of this patent is extended or adjusted under 35 U.S.C. 154(b) by 271 days.

(21) Appl. No.: 11/042,918

(22) Filed: Jan. 24, 2005

(65) Prior Publication Data

US 2005/0183291 A1 Aug. 25, 2005

Related U.S. Application Data

(60) Provisional application No. 60/538,895, filed on Jan. 23, 2004.

(51) Int. Cl.
*A43B 5/00* (2006.01)

(52) U.S. Cl. ..... 36/122; 36/125

(58) Field of Classification Search ..... 36/122, 36/124, 125, 7.7, 7.6
See application file for complete search history.

(56) References Cited

U.S. PATENT DOCUMENTS 5,259,128 A * 11/1993 Howell ..... 36/122
5,836,093 A * 11/1998 Gallay ..... 36/125
5,918,387 A * 7/1999 Emerson ..... 36/122
6,052,922 A * 4/2000 Bleck ..... 36/124
6,256,908 B1 * 7/2001 Warner ..... 36/124
6,694,645 B2 * 2/2004 Messmer et al. ..... 36/122
6,814,360 B2 * 11/2004 Kiniry et al. ..... 280/11.3
2003/0126765 A1 * 7/2003 Messmer et al. ..... 36/122
2003/0167657 A1 * 9/2003 Kiniry et al. ..... 36/125
2004/0231200 A1 * 11/2004 Forrest et al. ..... 36/122

* cited by examiner

*Primary Examiner*—Marie Patterson
(74) *Attorney, Agent, or Firm*—Thomas M. Freiburger

(57) ABSTRACT

A binding for securing the boot of a user to a snowshoe has a semi-rigid base with integral boot toe and boot heel control members and flexible upper members of a softer and more compliant material then that of the base connected to the base for embracing the boot upper; toe stops are fixed to the boot toe control members for engagement by and proper positioning of the toe of the boot; a heel strap extends between the boot heel control members and embraces the boot heel for securing the boot to the binding; and a 3-point closure system with quick mid-point connect/disconnect interconnects between the flexible upper members for varying the pressure exerted by the upper members on the boot upper while permitting easy separation of the upper members.

8 Claims, 9 Drawing Sheets

SNOWSHOE BINDING

CROSS-REFERENCE TO RELATED APPLICATIONS

This application claims the benefit of U.S. Provisional Application No. 60/538,895, filed Jan. 23, 2004.

BACKGROUND OF THE INVENTION

1. Field of the Invention

The invention relates to a binding for releasable engagement with the boot of a snowshoe user.

2. Description of Related Art

Over the recent past, snowshoeing has become a popular recreational activity, giving rise to the need for a snowshoe having a binding which adapts to a wide variety of footwear styles and sizes, permits easy entry and exit therefrom, and provides better control of the snowshoe.

While a wide variety of snowshoe bindings is available, none provides, in a single unified structure, a low cost binding which has good control characteristics, is adaptable to fit a wide variety of boot sizes and styles, is lightweight, and permits quick and easy entry and exit therefrom.

BRIEF SUMMARY OF THE INVENTION

The binding of the invention employs a dual material construction, which is readily adaptable for use with today's footwear/hiking boot designs. Herein, a semi-rigid base provides control and stability for the sole of the boot of a user, while flexible upper members, molded of a softer, more compliant material, embrace the boot upper, regardless of boot style or size.

The semi-rigid base is provided with a pair of spaced toe stop control members, each of which has a left/right specific toe stop insert which causes the boot to be properly positioned and aligned with the snowshoe, while preventing forward slippage of the boot.

The binding is provided with an inverted "V" or 3-point strap closure system with a quick midpoint connect/disconnect which is positioned over the forefoot of the boot of a user so as to be simple to use while being balanced to disperse pressure evenly across sensitive areas of the user's foot.

The unique 3-point strap dosure system allows near step-in mounting, with the user removing a web loop buckle, stepping into the binding, resetting the web loop buckle, and pulling the strap taut.

Herein, a unique web loop buckle is constructed of stainless steel, has a curvature to match the boot curvature, and incorporates a flat portion having a webbing slot to allow ease of web tightening.

The upper members comprise a harness-like system which cooperates with the left/right specific toe stop inserts for holding the forefoot of the boot securely in place while wrapping comfortably over the toe box of the boot, thereby eliminating undesirable pressure points while optimizing control on side hills, and a base which mirrors the sole of the boot.

The midfoot section of the binding/boot interface fully leverages and unifies the function of the hiking boot in conjunction with the control and support of the binding.

The binding is easily fit and adjusted to men's and women's specific winter boots, whether hiking or mountaineering styles or back country snowboard boots.

As an additional feature, the semi-rigid base of the binding has a pair of spaced, uniquely configured wing-like boot heel control members having an inward curvature in a vertical plane which align the heel of the user's boot while providing directional control and lateral rigidity and maximizing the efficiency and comfort of the user's stride. A heel strap is provided for securing the boot into the binding and holding the boot in place for additional control.

DETAILED DESCRIPTION OF THE INVENTION

Figure 1:
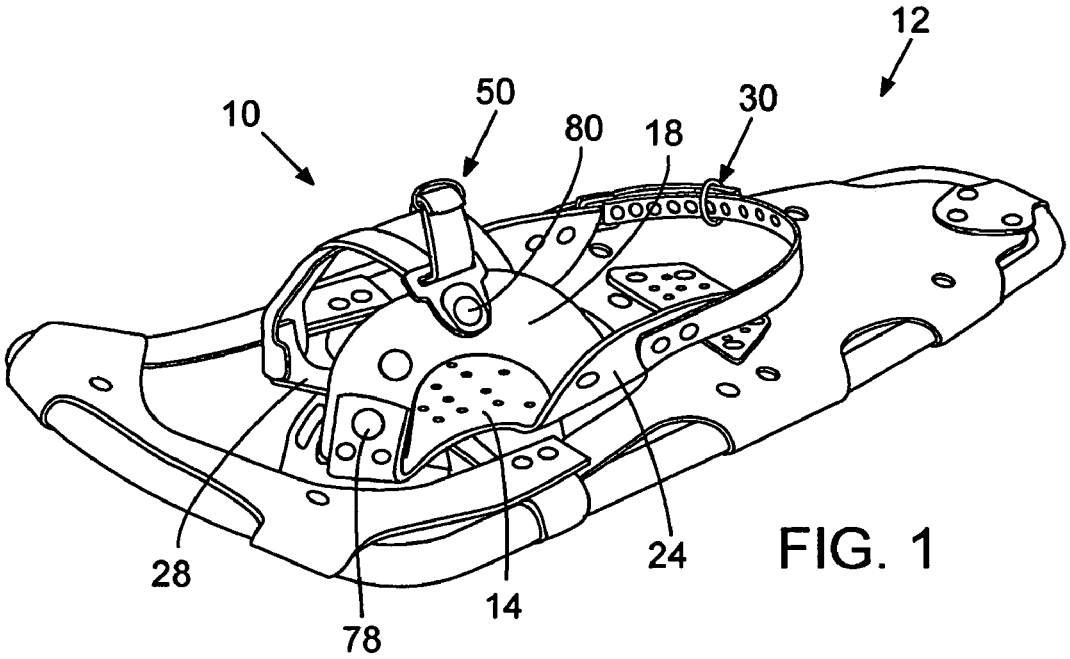
FIG. 1 is a top front perspective view of a snowshoe incorporating a right foot oriented binding embodying the invention.
Figure 2:
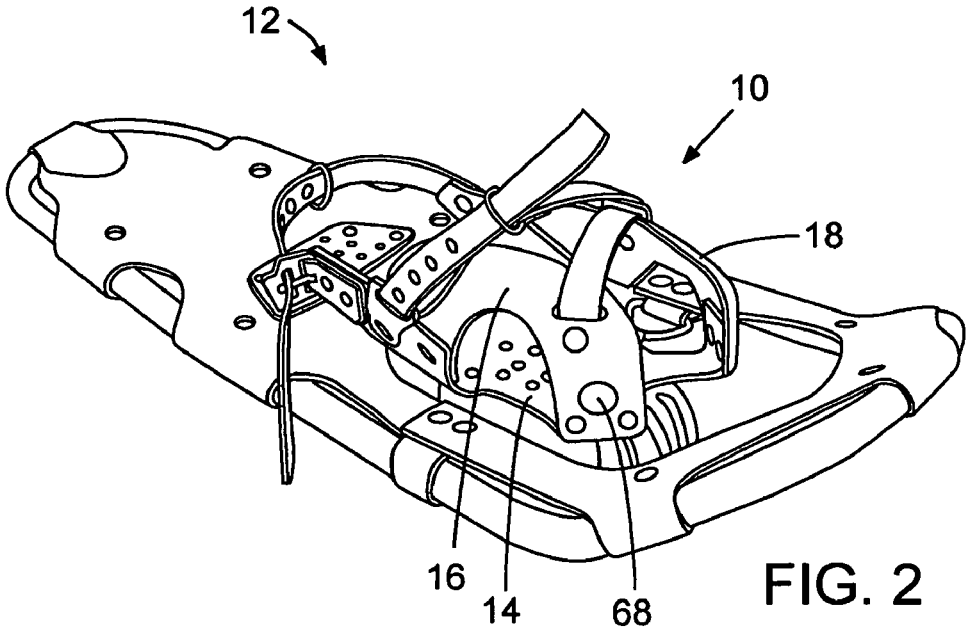
FIG. 2 is a top rear perspective view of the snowshoe and binding of FIG. 1.

With reference first to FIGS. 1 and 2 of the drawings, a snowshoe binding embodying a preferred form of the invention is generally indicated by 10 and is mounted relative to a snowshoe, generally indicated by 12.

It is to be noted that the binding illustrated in FIGS. 1 and 2 is right foot oriented and the binding illustrated in FIGS. 2-9 is left-foot oriented. However, the features of novelty as set forth herein are common to both right and left foot oriented bindings.

Hereinafter, the term "medial" refers to the inner or instep side of the binding, while the term "lateral" refers to the outer side of the binding.

Binding 10 includes a base member 14, fabricated from a lightweight, semi-rigid thermoplastic material, an inner or medial upper member 16 and an outer or lateral upper member 18, each fabricated from a lightweight, flexible elastomer material which is softer and more compliant than the material of base 14.

Base member 14 is fabricated as an integral unit and has a substantially flat, rectangular, main body portion 20 of appropriate size and configuration to substantially mirror the sole of the boot of a user.

Main body portion 20 of base 14 has a pair of spaced, wing-like, medial and lateral boot heel control members 22 and 24 respectively, extending upwardly and rearwardly from a rear edge thereof adjacent each side edge, and has a pair of spaced, tongue-like, medial and lateral boot toe control members 26 and 28 respectively, extending forwardly and angularly outwardly from a forward edge thereof adjacent each side edge.

Boot heel control members 22 and 24 curve inwardly toward each other in a vertical plane as they extend from the rear edge of main body portion 20 and curve outwardly away from each other in a vertical plane at their outermost or rearward ends, in order to better control the alignment of the boot of a user inserted into the binding, as will appear.

A heel strap of the "Voile" type is generally indicated by 30 and extends between boot heel control members 22 and 24 and includes a heel engaging strap portion 30*a* and a buckle carrying strap portion 30*b*.

Heel engaging strap portion 30*a* is fixed at one end as by rivets 32 to the outer face of lateral boot heel control member 24 and has an opposite free end engageable in a buckle 34 carried on the free end of strap portion 30*b*, the opposite end of which is fixed to the outer face of medial boot heel control member 22 as by rivets 36.

A tab 38 on buckle 34 is receivable in a selected one of a series of spaced openings 38*a* provided in strap portion 30*a* permitting easy adjustment of heel strap 30 relative to the heel of a boot placed in the binding.

Medial and lateral boot toe control members 26 and 28 respectively, diverge angularly outwardly in opposite directions from the forward edge of main body portion 20 of base member 14 of the binding.

An outer free end of medial or inner toe control member 26 curves upwardly to provide an upright anchor support 26*a*, while an outer free end of lateral or outer boot toe control member 28 curves upwardly to provide an upright anchor support 28*a*, all for purposes to appear.

Figure 3:
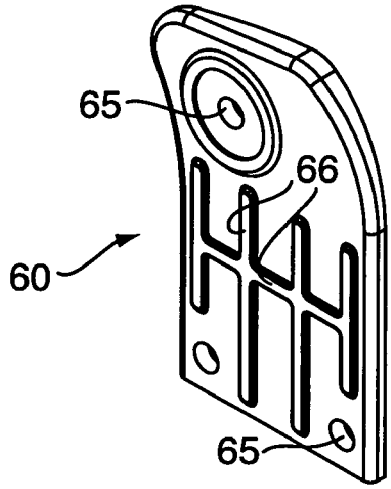
FIG. 3 is a front perspective view of the right inner or medial toe stop insert of the binding of the invention.

FIG. 3 illustrates a right specific medial or inner toe stop insert 60 which is fixed to the inner face of the anchor support 26*a* of each medial or inner boot toe control member 26 as by rivets 64 which pass through provided openings 65 in the toe stop insert 60.

Figure 4:
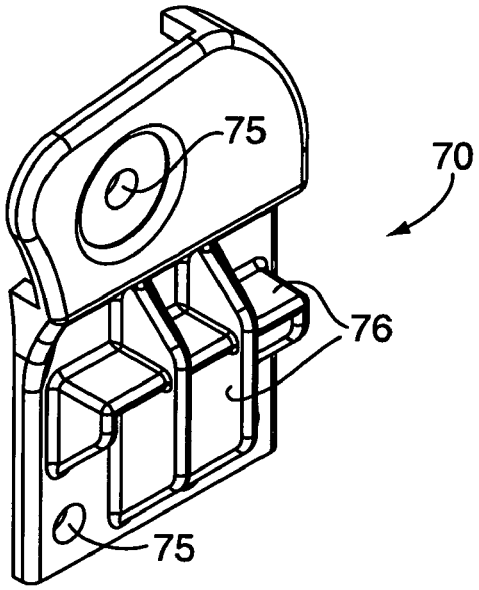
FIG. 4 is a front perspective view of the right outer or lateral tope stop insert of the binding of the invention.

FIG. 4 illustrates a right specific lateral or outer toe stop insert 70 which is fixed to the inner face of the anchor support 28*a* of each lateral or outer boot toe control member 28. As by rivets 76 which pass through provided openings 75 in the toe stop insert 70.

A series of outwardly-extending ribs 66 is provided on a vertical face of each left and right medial or inner toe stop insert 60, with the ribs being so positioned and configured as to be engaged by the toe of a boot of placed in the binding.

A series of outwardly-extending ribs 76 is provided on a vertical face of each left and right lateral or outer toe stop insert 70 and 72, with the ribs also being so positioned and configured as to be engaged by the toe of a boot placed in the binding.

Since the thickness of the ribs 76 of toe stop inserts 70 is greater than that of the ribs 66 of toe stop inserts 60, a positive stop and proper alignment of the boot with the snowshoe is provided.

Medial upper member 16 is of somewhat crescent shape in side elevation, in an upwardly arching, generally arcuate configuration forming an open area under the arch and above the base 14, and extends along one side edge of binding 10 and includes a depending tail portion 16*a* at one end which is fixed to an inner face of medial boot heel control member 22 as by a rivet 40, and a depending toe portion 16*b* at its opposite end which is fixed as by one of the rivets 64 to the outer face of anchor support member 26*a* on medial boot toe control member 26.

A circular boss 68 is provided on the outer face of anchor support member 26*a* and is receivable in a complementary circular opening 69 provided in depending toe portion 16*b* of medial upper member 16 thereby insuring proper location of said toe portion 16*b* relative to medial boot toe control member 26.

Lateral upper member 18, which is of similar configuration to that of medial upper member 16, is also in the form of an upwardly arching, generally arcuate configuration and extends along the opposite side edge of binding 10 and includes a depending tail portion 18*a* at one end which is fixed to an inner face of lateral boot heel control member 24 as by a rivet 44, and a depending toe portion 18*b* at its opposite end which is fixed as by one of the rivets 74 to the outer face of anchor support member 28*a* on lateral boot toe control member 28.

A circular boss 78 is provided on the outer face of anchor support member 28*a* and is receivable in a complementary circular opening 79 provided in depending toe portion 18*b* of lateral upper member 18 thereby insuring proper location of said toe portion 18*b* relative to lateral boot toe control member 28.

A 3-point strap closure system, generally indicated by 50, is provided for releasably interconnecting medial upper member 16 and lateral upper member 18.

3-point strap closure system 50 includes an instep strap 51 which is fixed at one of its ends as by one of the rivets 64 to medial upper member 16 immediately above medial boot toe control member 26*a* and has an opposite free end which extends through a buckle 54 pivotally connected to an upper end of a short strap 56 which is fixed at its opposite lower end by rivet 40 to the inner face of medial heel control 22 so as to be gripped between member 22 and tail portion 16*a* of medial upper member 16.

A quick connect/disconnect web loop buckle 58 is mounted for sliding movement on instep strap 51 between the fixed end of the strap at rivet 64 and buckle 54.

Figure 5:
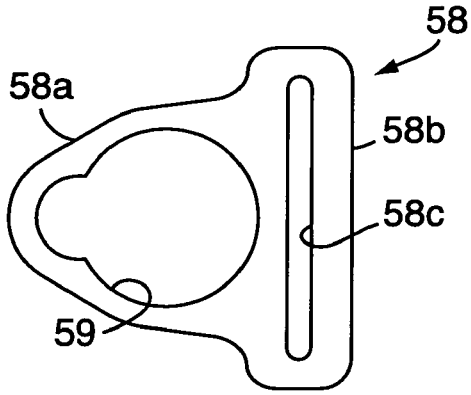
FIG. 5 is a top plan view of the web loop buckle of the 3-point strap closure system of the binding of the invention.
Figure 6:
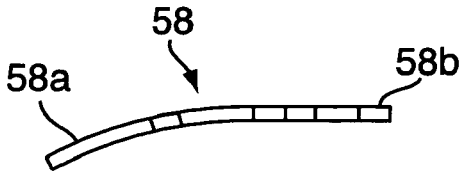
FIG. 6 is a side elevational view of the web loop buckle of FIG. 5.
Figure 7:
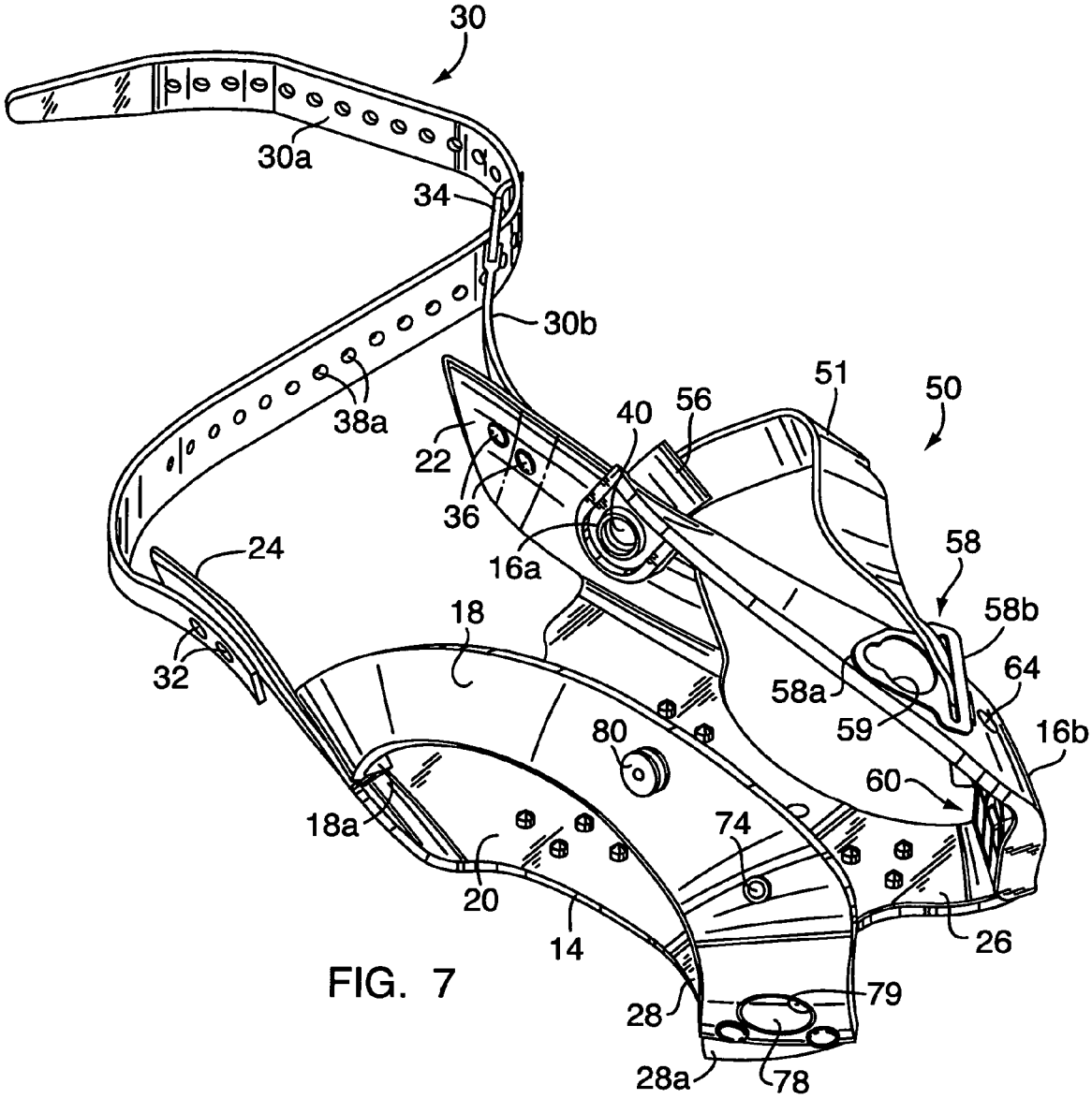
FIG. 7 is a top perspective view of a left foot oriented binding embodying the invention.
Figure 8:
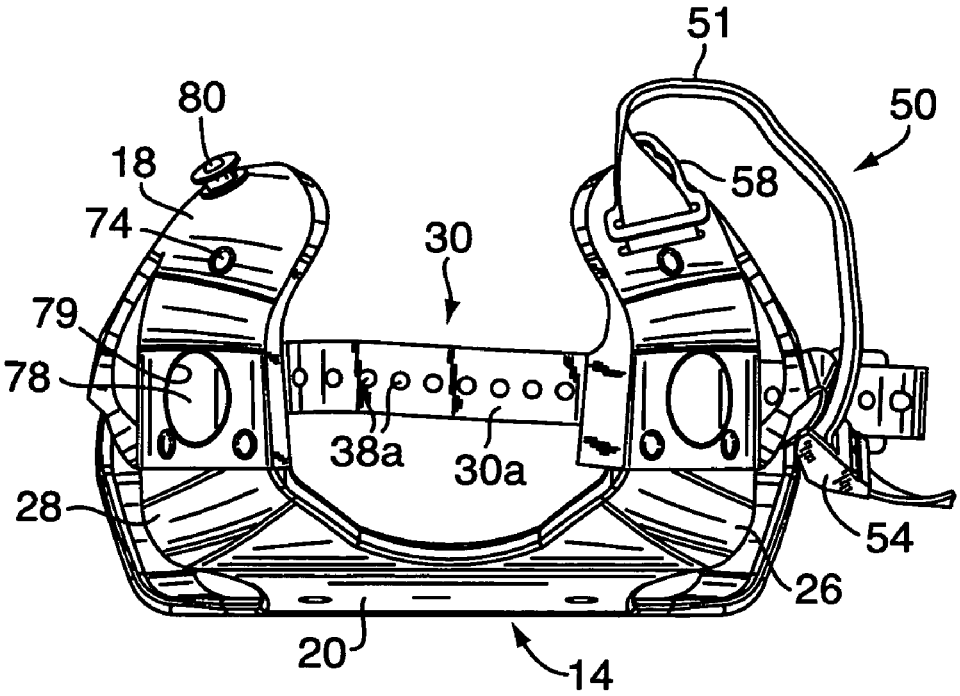
FIG. 8 is a right-end elevational view of the binding of FIG. 7.
Figure 9:
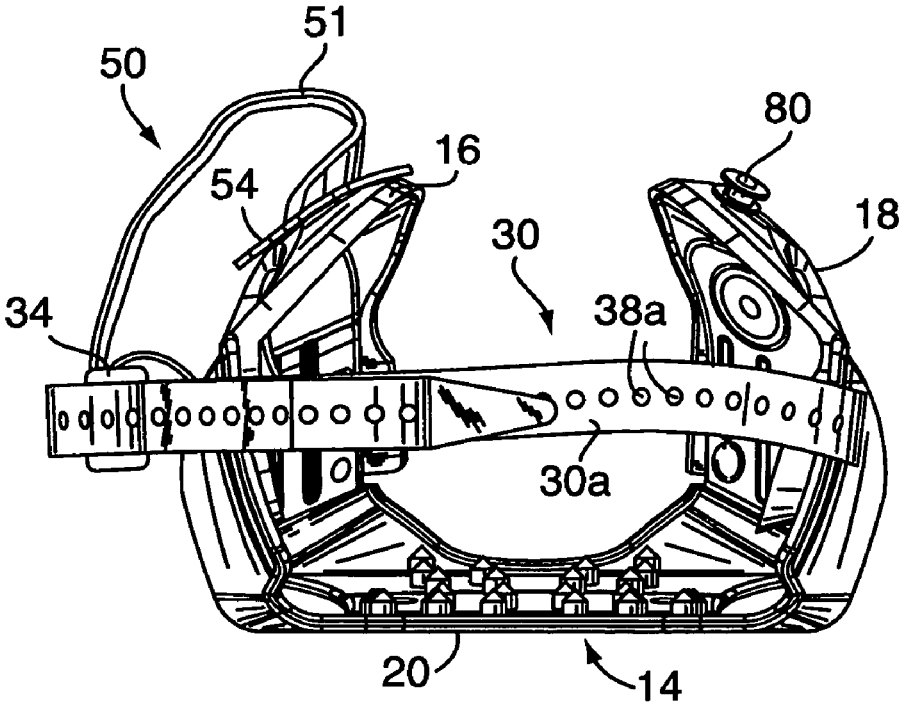
FIG. 9 is a left-end elevational view of the binding of FIG. 7.
Figure 10:
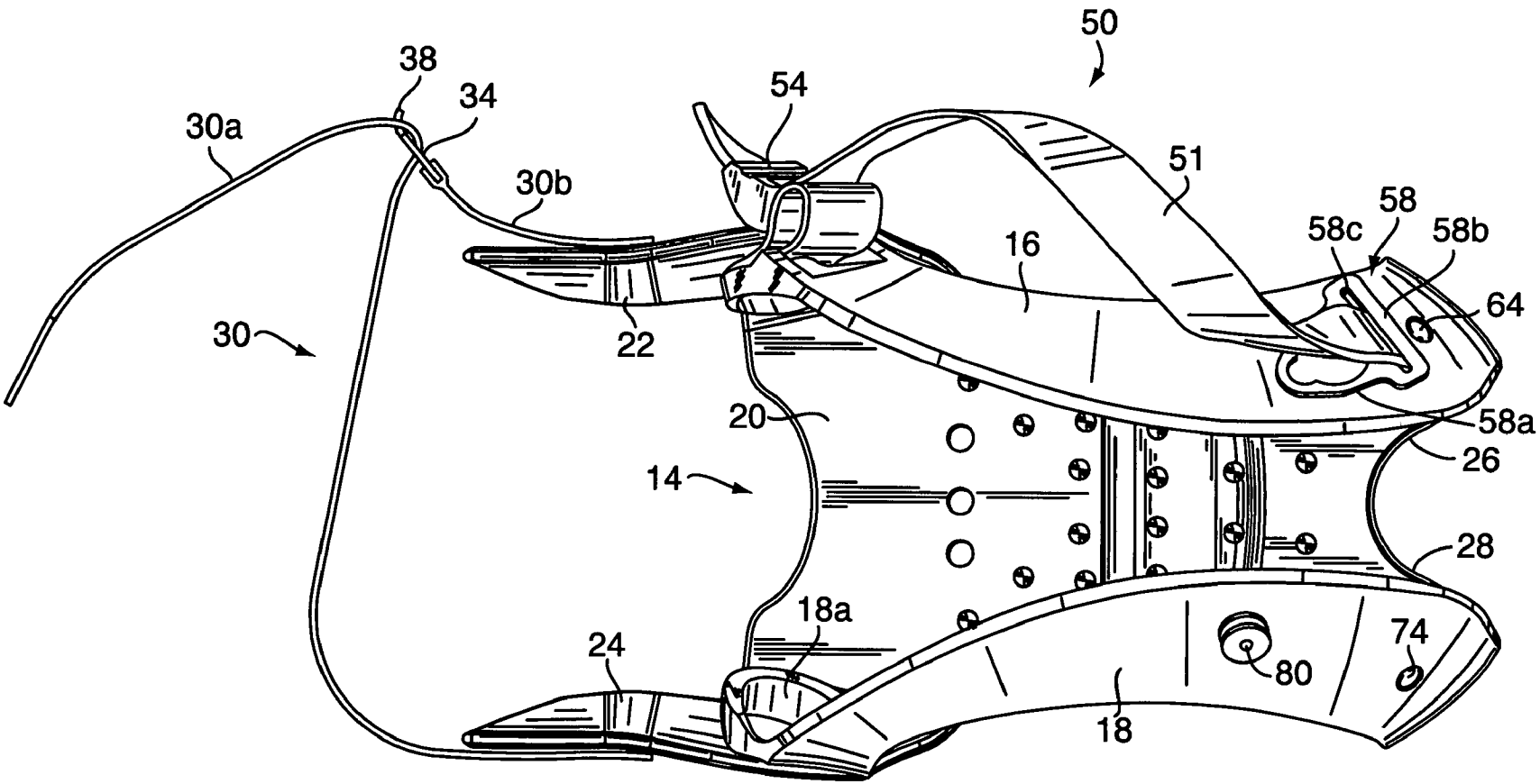
FIG. 10 is a top plan view of the binding of FIG. 7.
Figure 11:
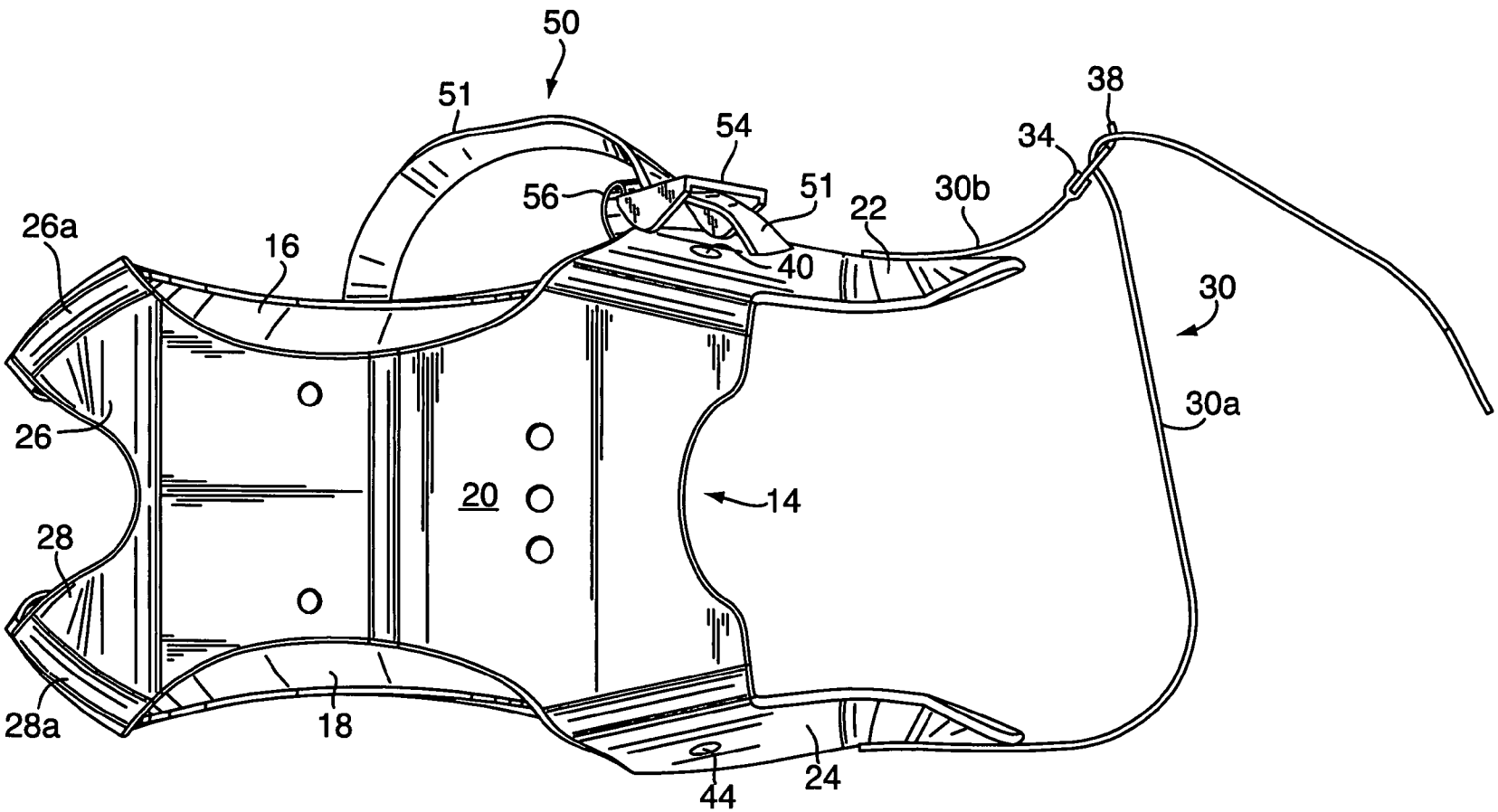
FIG. 11 is a bottom plan view of the binding of FIG. 7.
Figure 12:
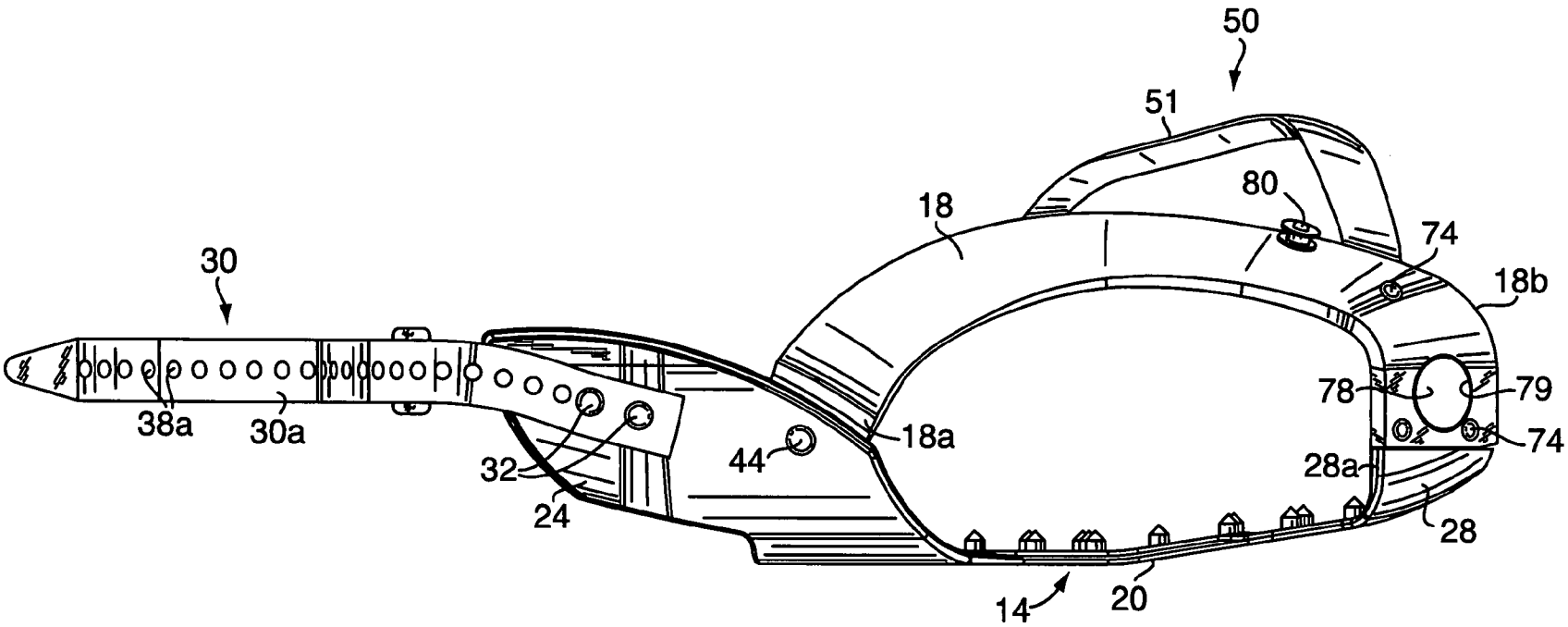
FIG. 12 is a front elevational view of the binding of FIG. 7.
Figure 13:
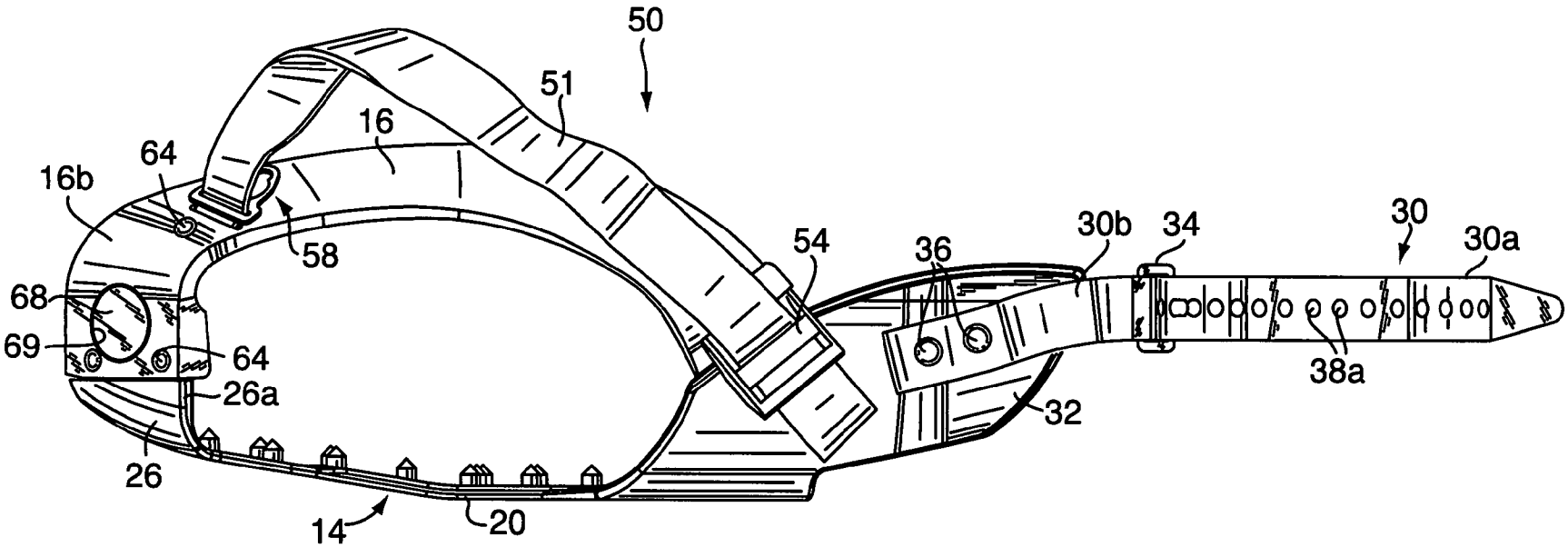
FIG. 13 is a rear elevational view of the binding of FIG. 7.
Figure 14:
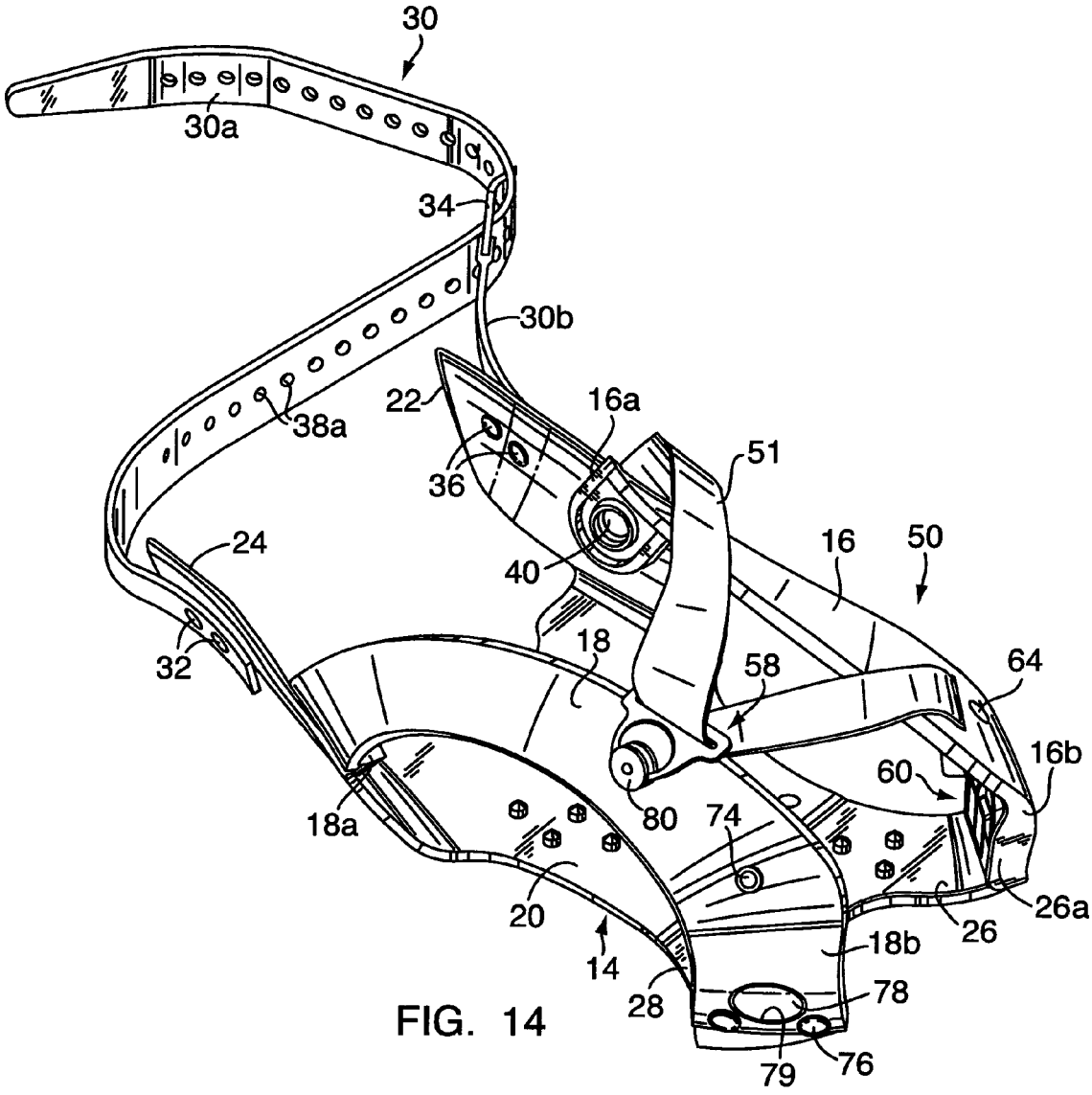
FIG. 14 is a top perspective view of the binding of FIG. 2 showing the 3-point strap closure system of the binding in an engaged position.

Web loop buckle 58, which is best seen in FIGS. 5 and 6, is preferably constructed of stainless steel so as to be weather resistant, has an open, somewhat triangular end portion 58*a* which has a curved profile in side elevation to match the curvature of the instep of a boot inserted in the binding and includes a flat extension 58*b* having a webbing slot 58*c* therein to permit ease of sliding movement of buckle 58 relative to instep strap 51.

End portion 58*a* of web loop buckle 58 is provided with an opening 59 of appropriate size and configuration as to be engageable with a post 80 which extends upwardly from lateral upper member 18.

Post 80 is so positioned along the length of lateral upper member 18 that when instep strap 51 crosses over the instep of a boot placed in the binding, end portion 58*a* of web loop buckle 58 may be easily engaged therewith.

Adjustment of instep strap 51 relative to buckle 54 will vary the pressure the strap exerts on medial upper member 16 and lateral upper member 18, thus varying the pressure which those members exert on the instep of a boot positioned therebelow.

Due to the unique crescent shape of the flexible medial and lateral upper members and their novel connection to the semi-rigid base, along with the 3-point strap system, pressure is exerted only on the desired toe, instep and heel portions of a boot positioned in the binding, while no undesirable pressure is exerted on the sides of the boot.

Quick connect/disconnect web loop buckle 58 may be easily removed from its engagement with post 80, thereby permitting separation of medial upper member 16 and lateral upper member 18 and, following the release of heel strap 30 from buckle 34, permitting removal of the user's boot from the binding.

What is claimed is:

1. A binding for releasably securing the boot of a user to a snowshoe, comprising:

a base having a pair of spaced boot toe control members at a front end and a pair of spaced boot heel control members at a back end, the toe control members comprising left/right specific toe stops positioned to contact and fix the position of a front end of a user's boot sole at left and right, the toe stops each being angled generally to align with a contacting edge of the boot sole, a pair of spaced apart medial and lateral flexible upper members connecting to and extending upward from the base for embracing the boot upper, each flexible member being shaped in an upwardly arching, generally arcuate configuration forming an open area below the arcuate configuration and above the base, and each flexible member having a forward end connected to and extending upwardly from a said boot toe control member and a rearward end connected to a said boot heel control member, an adjustable strap extendable between the flexible upper members, and a quick-disconnect buckle operable to secure the adjustable strap to retain the medial and lateral flexible members securely over the user's boot.

2. A binding according to claim 1, wherein the strap is generally in a V configuration with two ends of the strap secured to one of the flexible upper members and a mid portion of the strap supporting the buckle and extending as an apex of the V configuration to the other of the spaced flexible upper members.

3. A binding according to claim 2, wherein the quick-disconnect buckle comprises a buckle mounted for slidable movement on the strap in the mid portion, the buckle having a protruding end releasably engageable with said other spaced flexible upper member to releasably connect the two spaced flexible upper members over and embracing the boot upper.

4. A binding according to claim 3, wherein the strap has a length adjustment at the connection of an end of the strap to said one flexible upper member.

5. A binding according to claim 3, wherein the loop buckle is curved in shape, contoured generally to the shape of a user's boot upper.

6. A binding according to claim 1, further including left/right specific toe stops fixed to each boot toe control member for engagement by the toe of the boot, the left/right specific toe stops providing an abutment surface for defining a positive stop position and proper alignment of the boot with the snowshoe when contacted by the toe of the boot.

7. A binding according to claim 1, wherein each of the spaced boot heel control members curves inwardly/rearwardly to contact the sides of the user's boot heel for centering the boot and for improved control.

8. A binding according to claim 1, wherein the medial and lateral flexible upper members are configured as normally open and spaced apart, to the extent that a user can insert a boot down into the binding from above, when the adjustable strap is not securing the flexible upper members together.

* * * * *